US007828988B2

(12) United States Patent
Yamashita

(10) Patent No.: US 7,828,988 B2
(45) Date of Patent: Nov. 9, 2010

(54) ANISOTROPIC RARE EARTH BONDED MAGNET HAVING SELF-ORGANIZED NETWORK BOUNDARY PHASE AND PERMANENT MAGNET MOTOR UTILIZING THE SAME

(75) Inventor: Fumitoshi Yamashita, Nara (JP)

(73) Assignee: Panasonic Corporation, Osaka (JP)

( * ) Notice: Subject to any disclaimer, the term of this patent is extended or adjusted under 35 U.S.C. 154(b) by 802 days.

(21) Appl. No.: 11/659,619

(22) PCT Filed: Jul. 22, 2005

(86) PCT No.: PCT/JP2005/013479

§ 371 (c)(1),
(2), (4) Date: Feb. 7, 2007

(87) PCT Pub. No.: WO2006/022101

PCT Pub. Date: Mar. 2, 2006

(65) Prior Publication Data

US 2007/0246128 A1 Oct. 25, 2007

(30) Foreign Application Priority Data

Aug. 24, 2004 (JP) ..... 2004-243370

(51) Int. Cl.
*H01F 1/08* (2006.01)

(52) U.S. Cl. ..... 252/62.54; 148/301; 148/302

(58) Field of Classification Search ..... None
See application file for complete search history.

(56) References Cited

U.S. PATENT DOCUMENTS

| | | | | |
|---|---|---|---|---|
| 4,689,163 | A | 8/1987 | Yamashita et al. | |
| 5,888,417 | A * | 3/1999 | Akioka et al. | 252/62.55 |
| 6,641,919 | B1 | 11/2003 | Hayashi et al. | |
| 2001/0002276 | A1 | 5/2001 | Yamashita | |
| 2007/0228845 | A1 * | 10/2007 | Yamashita | 310/46 |

FOREIGN PATENT DOCUMENTS

| | | | |
|---|---|---|---|
| JP | 57-170501 | A | 10/1982 |
| JP | 62-263612 | A | 11/1987 |
| JP | 6-132107 | A | 5/1994 |
| JP | 6-330102 | A | 11/1994 |
| JP | 8-138923 | | 5/1996 |
| JP | 11-265812 | A | 9/1999 |

(Continued)

OTHER PUBLICATIONS

European Search Report issued in European Patent Application No. EP 05 76 2039, mailed Oct. 31, 2007.

*Primary Examiner*—John P Sheehan
(74) *Attorney, Agent, or Firm*—McDermott Will & Emery LLP

(57) ABSTRACT

An anisotropic rare-earth bonded magnet having a network boundary phase is provided by imparting melt fluidity accompanied by a slip to a composite granule and compressing and molding the composite granule in a magnetic field together with extensible polymer molecules and a chemical contact. In the bonded magnet, the maximum energy product is 147 kJ/m$^3$ in the thickness of 1 mm, or 127 kJ/m$^3$ in the thickness of 300 μm. This bonded magnet contributes to increase in output and decrease in size and weight of a permanent-magnet motor.

21 Claims, 5 Drawing Sheets

FOREIGN PATENT DOCUMENTS

| | | | |
|---|---|---|---|
| JP | 2000-232010 | A | 8/2000 |
| JP | 2004-296874 | | 10/2004 |
| JP | 2004-296875 | A | 10/2004 |
| JP | 2005-158863 | A | 6/2005 |
| WO | WO 03/085684 | A1 | 10/2003 |
| WO | WO 03/092021 | A1 | 11/2003 |

* cited by examiner

ANISOTROPIC RARE EARTH BONDED MAGNET HAVING SELF-ORGANIZED NETWORK BOUNDARY PHASE AND PERMANENT MAGNET MOTOR UTILIZING THE SAME

RELATED APPLICATIONS

This application is the U.S. National Phase under 35 U.S.C. §371 of International Application No. PCT/JP2005/013479, filed on Jul. 22, 2005, which in turn claims the benefit of Japanese Application No. 2004-243370, filed on Aug. 24, 2004, the disclosures of which Applications are incorporated by reference herein.

TECHNICAL FIELD

The present invention relates to an anisotropic rare-earth bonded magnet having a self-organized network boundary phase that is mounted to a permanent-magnet motor used for driving an electrical/electronic apparatus.

BACKGROUND ART

There are two kinds of typical rare-earth magnets, namely sintered magnets and quenched magnets produced by a melt spinning method.

A rare-earth sintered magnet having a Maximum Energy Product (MEP) of 216-296 kJ/m$^3$ is widely used in a relatively large motor of which mechanical output is between a few hundreds of W and a few tens of kW. Such a large motor is used in a Magnetic Resonance Image (MRI), Voice Coil Motor (VCM), Factory Automation (FA), or Electric Vehicle (EV).

While, a small-diameter annular isotropic rare-earth bonded magnet is used in a permanent-magnet small motor. This bonded magnet has an MEP of 72 kJ/m$^3$ or smaller, and is produced by fixing, through resin, RE-TM-B based quenched magnet powder that is obtained by crushing a melt span ribbon. A study for increasing the MEP of the isotropic rare-earth bonded magnet that is produced by crushing the melt span ribbon has not been significantly proceeding. Additionally, while increase in performance and added value of the electrical/electronic apparatus has been demanded, further decrease in size and weight and increase in output of the permanent-magnet motor have been always demanded.

For satisfying these demands, anisotropic bonded magnets have been actively developed. An anisotropic rare-earth bonded magnet having an MEP of 150 kJ/m$^3$ is also produced. Anisotropic rare-earth magnet powder of which coercive force $H_{CJ}$ is 1.20 MA/m or higher—heat stability is expected—has also been developed. However, a rare-earth bonded magnet with a high MEP made of the anisotropic rare-earth magnet powder is a cylindrical or cubic prototype, and is hardly applied to an actual and general small motor. That is because a magnet to be mounted to a target small motor of the present invention is required to have not a simple cylindrical or cubic shape but an annular or circular arc small-diameter shape having a thickness of 1 mm or shorter. Further, for producing the annular magnet, a radial anisotropic rare-earth bonded magnet which has magnetic anisotropy in the radial direction is required. A generating method of a radially oriented magnetic field is disclosed in Japanese Patent Unexamined Publication No. S57-170501. This generating method employs a die where magnetic material yokes and non-magnetic material yokes are combined alternately around an annular die cavity and an exciting coil is disposed outside them. This method requires large magnetomotive force in order to generate the radially oriented magnetic field of a predetermined intensity in the annular die cavity. For effectively collecting magnetic fluxes, which are excited in the exciting coil by the magnetic material yokes, from the outer periphery to the inside of the annular die cavity, the magnetic path of the magnetic material yokes must be elongated. Especially, when the annular die cavity has a small diameter (or long size), a considerable percentage of the magnetomotive force is consumed as leakage fluxes. As a result, the oriented magnetic field of the annular die cavity decreases, and hence only an annular or circular arc rare-earth bonded magnet having a low MEP can be actually manufactured. This is different from the case where the prototyped cylindrical or cubic rare-earth bonded magnet has a high MEP.

Additionally, the compression molding pressure is high, namely 600-1000 MPa. Therefore, a new surface or micro-crack is apt to occur in anisotropic rare-earth magnet powder during molding, the rectangularity of a demagnetization curve can be reduced by permanent degradation by oxidation, and the magnetic characteristic can be reduced by increase in irreversible demagnetizing factor.

SUMMARY OF THE INVENTION

The present invention provides an anisotropic rare-earth bonded magnet having a self-organized network boundary phase that is manufactured by the following method. Composite granule having rare-earth magnet powder, oligomer or prepolymer having a reaction substrate, and extensible polymer molecules is compressed and molded together with the extensible polymer molecules and chemical contact. A boundary phase mainly made of the extensible polymer molecules is arranged in a network shape around the composite granule. The composite granule and the extensible polymer molecules are chemically bonded together at a chemical contact point.

The present invention further provides a permanent magnet motor including an anisotropic rare-earth bonded magnet having a self-organized network boundary phase.

REFERENCE MARKS IN THE DRAWINGS

Figure 1A:
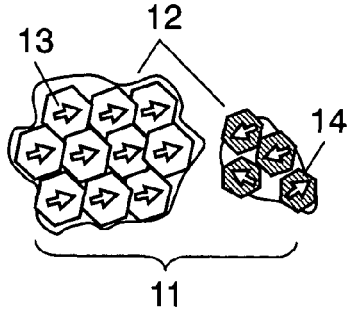
FIG. 1A illustrates an anisotropic bonded magnet in accordance with an exemplary embodiment of the present invention.

10 composite granule
11 rare-earth magnet powder
12 binder component (oligomer or prepolymer having reaction substrate)
13 magnetically anisotropic polycrystal assembly type $Nd_2Fe_{14}B$ powder
14 magnetically anisotropic single-domain-particle type $Sm_2Fe_{17}N_3$ micro-powder
20 boundary phase
21 extensible polymer molecule
30 chemical contact point
31 chemical contact
40 lubricant
50 motor
51 rotor iron core
52 stator
60 anisotropic bonded magnet of the present invention

DETAILED DESCRIPTION OF PREFERRED EMBODIMENTS

For satisfying demands for further decrease in size and weight and further increase in output of a permanent-magnet motor, the present invention provides an anisotropic bonded magnet having a network boundary phase having a shape flexibility using anisotropic rare-earth magnet powder. Here, the shape flexibility means that even decrease in diameter hardly varies the Maximum Energy Product (MEP). This anisotropic bonded magnet replaces a magnetically isotropic rare-earth bonded magnet (hereinafter referred to as "bonded magnet") where the MEP is not too high. When any annular or circular arc bonded magnet having a high MEP of 127 kJ/m$^3$ or higher that can be applied to a small motor can be provided, for example, increase in performance of an electrical/electronic apparatus is promoted. In other words, a new high-output power-saving permanent-magnet motor can be provided. The industrial MEP of the conventional isotropic bonded magnet is about 80 kJ/m$^3$. When any annular or circular arc bonded magnet having a high MEP of 127 kJ/m$^3$ or higher can be applied, output increase and downsizing by about 25% or more are expected dependently on design principles of the permanent-magnet motor. That is because the magnetic flux density of gap between the motor magnet and iron core is approximately square root of the ratio between MEPs.

In the bonded magnet having the self-organized network boundary phase of the present invention (hereinafter referred to as "anisotropic bonded magnet of the present invention"), the shape flexibility responding to various shapes from annular shape to circular arc shape is made compatible with the magnetic characteristic such as the MEP.

The anisotropic bonded magnet of the present invention is structured as follows. Composite granules having rare-earth magnet powder, oligomer or prepolymer having a reaction substrate, and extensible polymer molecules are compressed and molded together with the extensible polymer molecules and chemical contacts. Boundary phases mainly made of the extensible polymer molecules are arranged in network shapes around the composite granules. Thus, the anisotropic bonded magnet has a matrix structure including the following elements:

a binder component for fixing rare-earth magnet powder by chemical bond by forming chemical contact points; and extensible polymer molecules carrying a shape flexibility.

Preferably, a lubricant is added in melting and kneading. As the lubricant, pentaerythritol fatty acid ester is preferable. Addition amount thereof is 3-15 parts by weight to extensible polymer molecules of 100 parts by weight. Chemical contact points are disposed in the composite granules and the boundary phases, thereby improving the extensibility and weather resistance. Here, the boundary phases are formed in network shapes with the composite granules, as discussed above.

While, the composite granules and extensible polymer molecules are compressed at 5 MPa or more on the condition of melt flow accompanied by a slip, and the composite granules of which sectional surfaces orthogonal to the compressing direction are flat are produced. The composite granules and the network boundary phases form an anisotropic bonded magnet. The rare-earth magnet powder contained in the composite granules is made of magnetically anisotropic polycrystal assembly type $Nd_2Fe_{14}B$ powder having an average particle diameter of 50 μm or larger and magnetically anisotropic single-domain-particle type $Sm_2Fe_{17}N_3$ micro-powder having an average particle diameter of 3 μm or smaller. Especially, the percentage of single-domain-particle type $Sm_2Fe_{17}N_3$ micro-powder in the rare-earth magnet powder is set at 40% or more.

Preferably, one or two kinds of epoxy compounds that have an oxirane ring and a melting point of 70-100° C. are used as the binder component, and polyamide having a melting point of 80-150° C. is used as the extensible polymer molecules. As the chemical contacts, a powder-like latent epoxy resin hardener capable of crosslinking-reaction with the binder component and the reaction substrate of the extensible polymer molecules is preferably used.

The percentage of the rare-earth magnet powder in the anisotropic bonded magnet of the present invention is set at 95 wt % or more. The bonded magnet having a relative density of 98% or higher and a plate shape with a thickness of 1.5 mm or shorter is produced, by performing compression and molding in a magnetic field that is oriented in the direction perpendicular to the surface, in the in-surface direction, or regularly repeatedly between both directions. Finally, the whole bonded magnet is mechanically rolled via the chemical contact points, and is deformed into an annular shape using the flexibility occurring in the rolling direction. Alternatively, the extensibility is partly varied by stamping to deform the bonded magnet into a circular arc shape.

The anisotropic bonded magnet of the present invention allows increase in performance of a small permanent-magnet motor as a target of the present invention, because the MEP at 20° C. after magnetization at 2.0 MA/m is usually 127 kJ/m$^3$ or more.

Figure 1B:
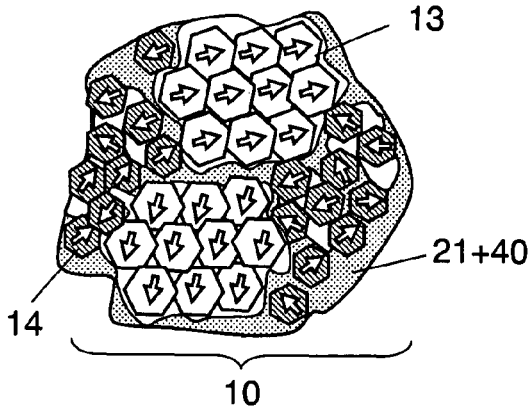
FIG. 1B illustrates the anisotropic bonded magnet in accordance with the exemplary embodiment.
Figure 1C:
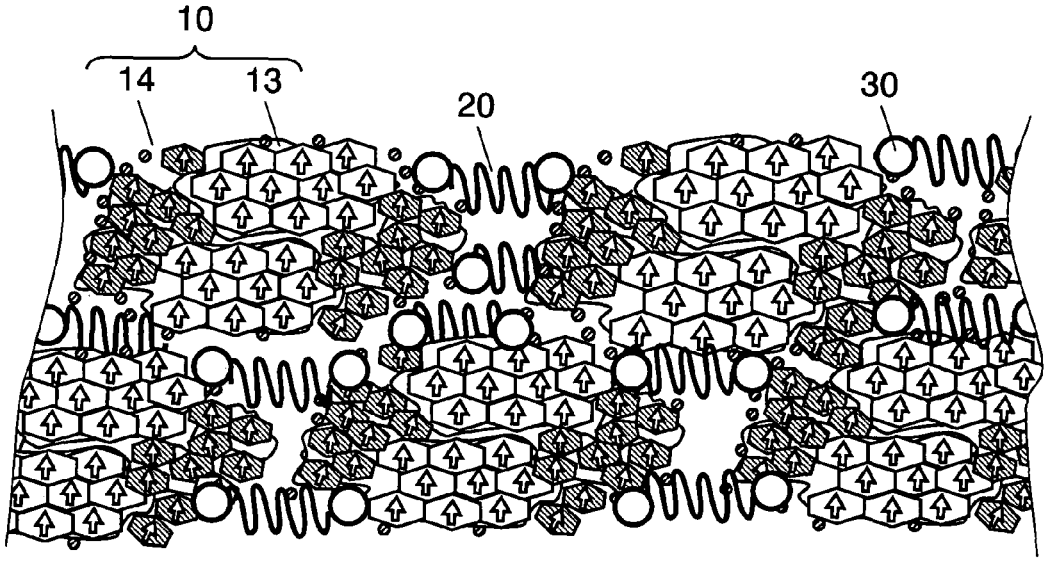
FIG. 1C illustrates the anisotropic bonded magnet in accordance with the exemplary embodiment.

FIG. 1A through FIG. 1C illustrate an anisotropic bonded magnet of the present invention. As shown in FIG. 1A, rare-earth magnet powder 11 coated with binder component (oligomer or prepolymer having a reaction substrate) 12 is composed of magnetically anisotropic polycrystal assembly type $Nd_2Fe_{14}B$ powder 13 having an average particle diameter of 50 μm or larger and magnetically anisotropic single-domain-particle type $Sm_2Fe_{17}N_3$ micro-powder 14 having an average particle diameter of 3 μm or smaller.

FIG. 1B shows composite granule 10 that has a reduced cavity part and includes the following elements:

the coated magnet powder produced by melting and kneading rare-earth magnet powder 11 and extensible polymer molecules 21, cooling them, and roughly crushing them;

binder component 12; and extensible polymer molecules 21.

Alternatively, FIG. 1B shows composite granule 10 that has a reduced cavity part and includes the following elements:

the coated magnet powder produced by melting and kneading rare-earth magnet powder 11, extensible polymer molecules 21, and lubricant 40, cooling them, and roughly crushing them;

binder component 12;

extensible polymer molecules 21; and lubricant 40.

FIG. 1C shows an anisotropic bonded magnet of the present invention having composite granules 10, network-shaped boundary phases 20 that are mainly made of extensible polymer molecules 21 and are arranged in the boundaries between composite granules 10, and chemical points 30 disposed in composite granules 10 and boundary phases 20.

Thus, boundary phases 20 can compensate for reduction in extensibility of the magnet that accompanies increase in volume fraction of rare-earth magnet powder 11 in composite granules 10. When boundary phases 20 have a network shape and are continuous between composite granules 10, the network-shaped boundary phases 20 effectively increase mechanical extensibility of the whole magnet. As a result, anisotropic bonded magnet 60 of the present invention that has a shape flexibility responding to shapes from an annular shape to a circular shape and has a high MEP can be provided.

As polycrystal assembly type $Nd_2Fe_{14}B$ powder 13 of rare-earth magnet powder 11 of the present invention, polycrystal assembly type $Nd_2Fe_{14}B$ powder prepared by hot die-up-setting, or polycrystal assembly type $Nd_2Fe_{14}B$ powder prepared by a Hydrogenation Decomposition Desorption Recombination (HDDR) treatment can be used. Zn obtained by previously photo-decomposing the surface of rare-earth magnet powder 11 or inactivated rare-earth magnet powder may be used. Preferably, coercive force $H_{CJ}$ at 20° C. after 4 MA/m pulse magnetization of polycrystal assembly type $Nd_2Fe_{14}B$ powder 13 is 1 MA/m or greater.

While, magnetically anisotropic single-domain-particle type $Sm_2Fe_{17}N_3$ micro-powder is obtained by producing an RE-Fe based alloy or RE-(Fe, Co) based alloy in a Reduction Diffusion (RD) method, nitriding it, and then pulverizing it. The pulverization is performed with a jet mill, a vibration ball mill, a rotation ball mill so that the Fisher average particle diameter is 1.5 μm or smaller, preferably 1.2 μm or shorter. Preferably, the surface of the micro-powder is coated with slow oxidation film by wet or dry treatment so as to improve the handling property such as ignition prevention. The micro-powder may undergo one or more kinds of surface treatments, such as a forming method of metal film or a forming method of inorganic film.

The present invention prepares rare-earth magnet powder where the surface of polycrystal assembly type $Nd_2Fe_{14}B$ powder 13 or single-domain-particle type $Sm_2Fe_{17}N_3$ micro-powder 14 is coated with binder component (oligomer or prepolymer) 12. Specifically, polycrystal assembly type $Nd_2Fe_{14}B$ powder 13 or single-domain-particle type $Sm_2Fe_{17}N_3$ micro-powder 14 is previously, wetly mixed with organic solvent solution of binder component 12. Then, the mixture is desolvated and shredded, and classified as appropriate. As the binder component of the present invention, an epoxy compound that has a melting point of 70-100° C. and has at least two oxirane rings in a molecular chain is preferable. For example, a material obtained from bisphenol group and from either of epi-chlorohydrin and substituted epi-chlorohydrin, or epoxyoligomer obtained by other various methods is used. Preferably, polyglycidyl ether-o-cresol novolac type epoxyoligomer is used where epoxy equivalence is 205-220 g/eq and melting point is 70-76° C.

As composite granules 10, preferably, polycrystal assembly type $Nd_2Fe_{14}B$ powder 13 and single-domain-particle type $Sm_2Fe_{17}N_3$ micro-powder 14 are concurrently used in the present invention. Composite granules 10 are produced by melting and kneading, at the melting point of extensible polymer molecules 21 or higher, extensible polymer molecules 21 and rare-earth magnet powder where polycrystal assembly type $Nd_2Fe_{14}B$ powder 13 and single-domain-particle type $Sm_2Fe_{17}N_3$ micro-powder 14 are coated with binder component 12, and by roughly crushing them. It is suitable to set the percentage of $Nd_2Fe_{14}B$ powder 13 and $Sm_2Fe_{17}N_3$ micro-powder 14 in the bonded magnet at 95 wt % or more, and to set the percentage of $Sm_2Fe_{17}N_3$ micro-powder 14 at 40 wt % or more, from the viewpoint of MEP increase or initial irreversible magnetic flux loss.

Such composite granules 10 can be easily prepared using a heatable kneading device such as a roll mill or a two-screw extruder.

As extensible polymer molecules 21 of the present invention, polyamide is preferable. For example, nylon such as nylon 6, nylon 66, nylon 610, nylon 612, nylon 11, or nylon 12, copolymer nylon, or a mixture of them is used. More preferably, low-melting point polyamide is used. For example, polyamide copolymer and alcohol-soluble polyamide where melting point is 80-150° C., acid value is 10 or smaller, amine value is 20 or smaller, and molecular weight is 4000-12000 are preferable.

Such extensible polymer molecules 21 are softened or melted in a manufacturing stage of the bonded magnet of the present invention, or at least part thereof is dissolved in epoxyoligomer suitable as binder component 12, so that high mechanical strength is obtained while the reactivity at a low temperature is kept.

In the present invention, preferably, lubricant 40 for generating melt flow accompanied by a slip is also melted and kneaded and roughly crushed in composite granules 10. As lubricant 40, a compound consistently exhibiting internal lubrication acting on rare-earth magnet powder 11 and external lubrication acting on a die wall surface is preferable. For example, pentaerythritol fatty triester compound (hereinafter referred to as "PETE") can be used. When the addition amount of PETE is 3-15 parts by weight to extensible polymer molecules of 100 parts by weight, the melt flow accompanied by a remarkable slip occurs. When the addition amount exceeds 15 parts by weight, the external lubricating effect becomes too strong, and mixing itself into the composite granules becomes difficult. When the addition amount is smaller than 3 parts by weight, the melt flow phenomenon accompanied by the slip is not remarkable.

On the condition that melt flow accompanied by a slip occurs in composite granules 10, even when the percentage of rare-earth magnet powder 11 is set at 95 wt % or more, a thin-plate-like magnet with a thickness of about 1 mm can be compressed and molded while high orientation is kept.

As chemical contact 31 forming chemical contact point 30 by reacting with binder component 12 and the reaction substrate of extensible polymer molecules 21, a powder-like latent epoxy resin hardener is used, for example. Here, the latent epoxy resin hardener is made of a hydantoin derivative expressed by (Formula 1)

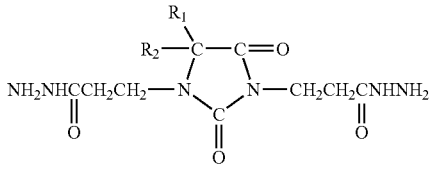

Where, R1 and R2 are H or alkyl residue.

Composite granules 10 of the present invention are mixed with extensible polymer molecules 21 and powder-like chemical contacts 31, and the mixture is compressed and molded in an oriented magnetic field. Here, chemical contacts 31 form chemical contact points 30 with composite granules 10 and extensible polymer molecules 21. The compressing and molding pressure is set at 50 MPa or lower. In such material form and molding condition, the occurrence of a new surface or a micro-crack can be suppressed in rare-earth magnet powder 13. Therefore, decrease in magnetic characteristic corresponding to permanent degradation oxidation can be suppressed.

During compression and molding in the oriented magnetic field, thermal conduction from the die puts composite granules 10 and extensible polymer molecules 21 into a melted state. As a result, polycrystal assembly type $Nd_2Fe_{14}B$ powder 13 and single-domain-particle type $Sm_2Fe_{17}N_3$ micro-powder 14 are re-arranged by the oriented magnetic field into a state where easy axes of magnetization (C axes) are aligned to a constant direction. The compression and molding is performed in this state at 50 MPa or lower, heating and pressurization is continued, chemical contact points 30 are formed, and anisotropic bonded magnet 60 of the present invention is produced. Alternatively, temporary removal from the die may be performed, and then chemical contact points 30 may be formed by hardening.

The anisotropic direction may be one of the direction perpendicular to the surface of the plate-like magnet and the in-surface direction, or regular repetition of both directions. In the case of the direction perpendicular to the surface, compression and molding is performed in an orthogonal or parallel oriented magnetic field. In the case of the in-surface direction, compression and molding is performed in an orthogonal oriented magnetic field. In the case of regular repetition between the perpendicular and in-surface directions, the oriented magnetic field distribution can be achieved in a desired direction, using an existing die for a rare-earth sintered magnet or an existing die for a combination of the rare-earth sintered magnet and a soft magnetic material of high magnetic permeability such as permendur.

The anisotropic bonded magnet of the present invention preferably has a thin plate shape with a thickness of 1.5 mm or shorter. Additionally, the relative density of the anisotropic bonded magnet is preferably 98% or higher. When the relative density of the magnet is low, heating in the atmosphere in forming chemical contact points 30 increases the reduction amount of the MEP corresponding to the permanent degradation of rare-earth magnet powder 11, in response to the void amount.

Figure 2:
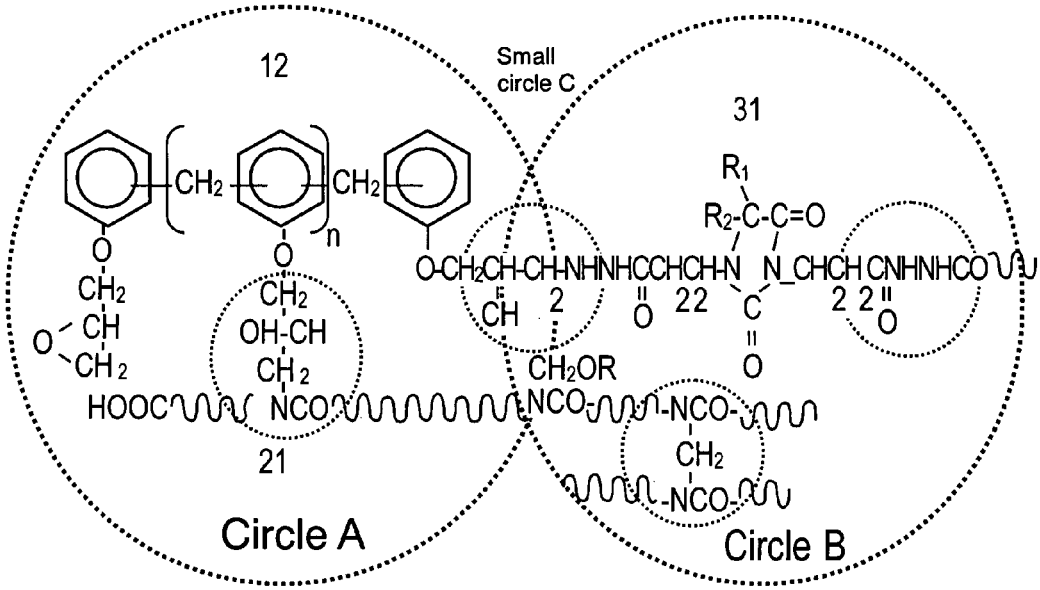
FIG. 2 illustrates one example of the chemical structure of the anisotropic bonded magnet in accordance with the exemplary embodiment.

FIG. 2 is a schematic diagram showing one example of the chemical structure of anisotropic bonded magnet 60 of the present invention. In FIG. 2, the range of circle A by the dotted line shows composite granule 10, and the range of circle B by the dotted line shows boundary phase 20. Binder component 12 contained in composite granule 10 is polyglycidyl ether-o-cresol novolac type epoxyoligomer for fixing rare-earth magnet powder 11. As extensible polymer molecules 21 existing in a part of circle A and circle B, polyamide having a carboxyl terminal is used. Small circles C in FIG. 2 show a chemical contact points, and show the chemical bond of chemical contact points 30 by chemical contacts 31 expressed by Formula 1. In FIG. 2, binder component 12 for fixing rare-earth magnet powder 11 and a functional group of extensible polymer molecules 21 carrying molecular chain orientation directly and thermally react with chemical contacts 31 or binder component 12 to cause self organization. In this example, chemical contacts 31 intrude into binder component 12 and extensible polymer molecules 21 at the melting point or higher, and chemically bond to them.

In anisotropic bonded magnet 60 of the present invention, the boundary phases between the composite granules are formed in network shapes, and the extensible polymer molecules are oriented with a molecular chain in the extension direction. In this case, the plate-like magnet is deformed into an annular shape or a circular arc shape using the flexibility occurring in the corresponding direction, and can be used in a permanent-magnet motor. As the extending method, rolling is preferable for obtaining an annular magnet, and stamping is preferable for obtaining a circular magnet. These methods may be concurrently used.

The anisotropic bonded magnet of the present invention allows increase in performance of various permanent-magnet motors as a target of the present invention, because the MEP at 20° C. after magnetization at 2.0 MA/m is 127 kJ/m$^3$ or more.

The anisotropic bonded magnet of the present invention is described with an exemplary embodiment in more detail. The present invention is not limited to the exemplary embodiment. The drawings are schematic and do not show each position dimensionally precisely.

EXEMPLARY EMBODIMENT

1. Raw Material

The present embodiment employs magnetically anisotropic polycrystal assembly type $Nd_2Fe_{14}B$ powder 13 ($Nd_{12.3}Dy_{0.3}Fe_{64.7}Co_{12.3}B_{6.0}Ga_{0.6}Zr_{0.1}$) with an average particle diameter of 80 μm prepared by the HDDR treatment and magnetically anisotropic single-domain-particle type $Sm_2Fe_{17}N_3$ micro-powder 14 with an average particle diameter of 3 μm produced by the RD method. As binder component 12 of the present invention, polyglycidyl ether-o-cresol novolac type epoxyoligomer where epoxy equivalence is 205-220 g/eq and melting point is 70-76° C. is used. As extensible polymer molecules 21, polyamide powder containing a plasticizer is used where melting point is 80° C., acid number is 10 or smaller, amine number is 20 or smaller, and molecular weight is 4000-12000. As chemical contact 31 forming chemical contact point 30, a latent epoxy resin hardener (hydantoin derivative) is used that has a structure expressed by Formula 1, and has an average particle diameter of 3 μm and a melting point of 80-100° C. As lubricant 40, PETE with a melting point of 52° C. is used.

2. Reduction of Void Amount and Thinning

The anisotropic bonded magnet of the present invention has composite granules 10 as a main component and boundary phases 20 arranged in network shapes around composite granules 10, and composite granules 10 and boundary phases 20 are chemically bonded together through chemical contact points 30.

In the first step for preparing the anisotropic bonded magnet of the present invention, rare-earth magnet powder is produced by applying binder component 12 to each of polycrystal assembly type $Nd_2Fe_{14}B$ powder 13 and single-domain-particle type $Sm_2Fe_{17}N_3$ micro-powder 14. Then, the rare-earth magnet powder is melted and kneaded together with extensible polymer molecules 21 to form composite granules 10 having melt fluidity. Each granule is composed of polycrystal assembly type $Nd_2Fe_{14}B$ powder 13, single-domain-particle type $Sm_2Fe_{17}N_3$ micro-powder 14, and extensible polymer molecules 21. More preferably, composite granules 10 contain lubricant 40 for generating melt fluidity accompanied by a slip, and the particle diameter of them is 500 μm or smaller.

In the second step for preparing the anisotropic bonded magnet of the present invention, composite granules 10 are compressed and molded together with extensible polymer molecules 21 for forming boundary phases 20 and chemical contacts 31 forming chemical contact points 30 in the oriented magnetic field. Finally, the prepared thin anisotropic bonded magnet of the present invention that has been prepared in the above-mentioned method has an arbitrary shape from an annular shape to a circular arc shape so as to be applied to permanent-magnet motors of various forms using the extensibility.

In the present embodiment, binder component 12 of 3 parts by weight is mixed with $Nd_2Fe_{14}B$ powder 13 of 60 parts by weight, and binder component 12 of 0.8 parts by weight is mixed with $Sm_2Fe_{17}N_3$ micro-powder 14 of 40 parts by weight. Binder component 12 is previously formed as acetone solution, and is wetly mixed with $Nd_2Fe_{14}B$ powder 13 or $Sm_2Fe_{17}N_3$ micro-powder 14, and then the acetone is emitted at 80° C., thereby producing surface-treated rare-earth magnet powder of the present invention.

Then, polyamide of 3 parts by weight as extensible polymer molecules 21 and PETE of 0.3 parts by weight are melted and kneaded together with surface-treated rare-earth magnet powder of 100 parts by weight by a roll mill at 120° C. Here, rare-earth magnet powder contains $Nd_2Fe_{14}B$ powder 13 and $Sm_2Fe_{17}N_3$ micro-powder 14 at a reference mixing ratio of 6 to 4. They are cooled and roughly crushed to 500 μm or smaller, thereby producing composite granules 10 of the present invention. While, second composite granules of the present invention are produced similarly to composite granules 10, but PETE is not added here.

Further, extensible polymer molecules 21 of 0.5 parts by weight and chemical contacts 31 of 0.3 parts by weight are mixed into composite granules 10 of 100 parts by weight, and the mixture is used as material for molding. This material of 5 g is compressed at 140° C. in a parallel magnetic field of 1.4 MA/m.

Figure 3:
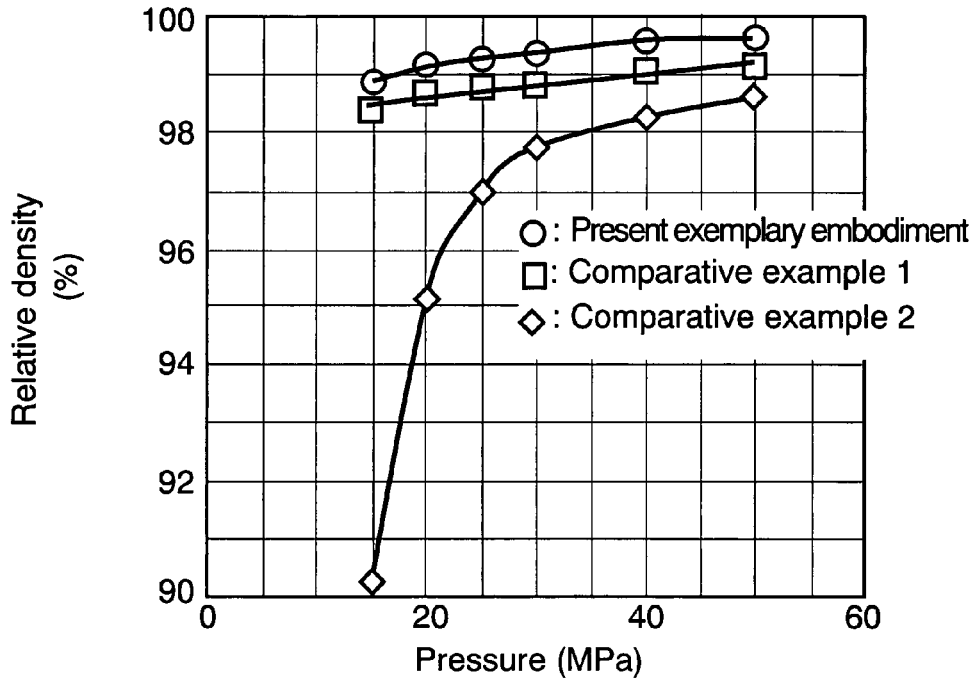
FIG. 3 is a diagram showing pressure dependence of relative density of the anisotropic bonded magnet in accordance with the exemplary embodiment.

FIG. 3 is a diagram showing the relation between the relative density and compressing pressure of the anisotropic bonded magnet of the present embodiment. In FIG. 3, comparative example 1 shows a characteristic curve obtained when chemical contacts 31 of 0.3 parts by weight are mixed into composite granules 10 of the present invention of 100 parts by weight of the present invention (second addition of extensible polymer molecules 21 is not performed). Comparative example 2 shows a characteristic curve obtained when chemical contacts 31 of 0.3 parts by weight are mixed into second composite granules of the present invention of 100 parts by weight (PETE is not added). In the present embodiment or comparative example 1, melt flow by a slip by the lubricant (PETE) reduces pressure dependence of relative density in a range of 15-50 MPa. However, in either of comparative examples 1 and 2, no network boundary phase exists on the boundary surface after compression and molding of the composite granules. Therefore, in the present embodiment having network boundary phases 20, the pressure dependence is similar to that in comparative example 1 but the relative density is higher than that in comparative example 1. In other words, boundary phases 20 have an effect of filling in voids in the bonded magnet. Such reduction in void amount in the bonded magnet suppresses the permanent degradation due to oxidation of rare-earth magnet powder 11. In the present embodiment, a bonded magnet having a relative density of 99% or higher (porosity is less than 1%) at compressing pressure 15 MPa is obtained. In the anisotropic bonded magnet of the present invention, thus, network boundary phases 20 significantly contribute to the pressure dependence of relative density.

Figure 4:
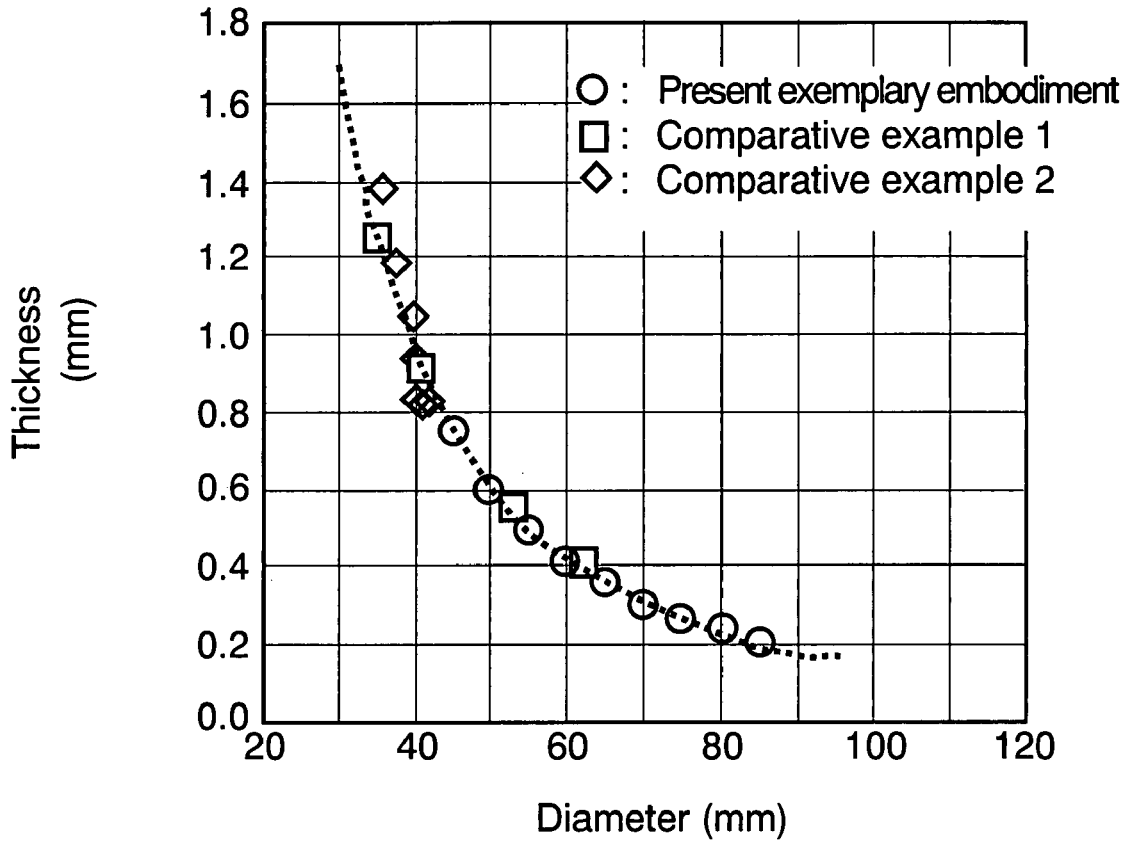
FIG. 4 is a diagram showing the relation between diameter and thickness of disk extension of the anisotropic bonded magnet in accordance with the exemplary embodiment.

FIG. 4 is a diagram showing the relation between diameter and thickness of disk extension in the present embodiment, comparative example 1, and comparative example 2. In FIG. 4, the dotted curved line shows the relation between the diameter and thickness of the magnet obtained when the relative density is assumed to be 100%. Comparative example 2 is out of the curved line, and indicates that there are many voids and it is difficult to produce a magnet with a thickness of 830 μm or shorter. While, comparative example 1 is plotted on the dotted line showing the relation between the diameter and thickness of the magnet at relative density 100%, and indicates that the number of voids is small. However, the comparative example 1 indicates that it is difficult to manufacture a magnet with a thickness of 400 μm or shorter. The present embodiment is plotted on the dotted line showing the relation between the diameter and thickness of the magnet at relative density 100%, and indicates that a bonded magnet with a thickness up to 200 μm can be produced. In the present invention, a thin bonded magnet having an extremely small number of voids can be produced.

In the anisotropic bonded magnet of the present invention, thus, the network boundary phases significantly contribute to decrease of voids in the bonded magnet and thinning thereof. Such decrease of voids in the bonded magnet and thinning thereof are advantageous in producing an annular magnet with a smaller diameter, when the magnet becomes flexible due to extension by rolling of the boundary phases.

3. Shape Flexibility and MEP of Magnet

Figure 5:
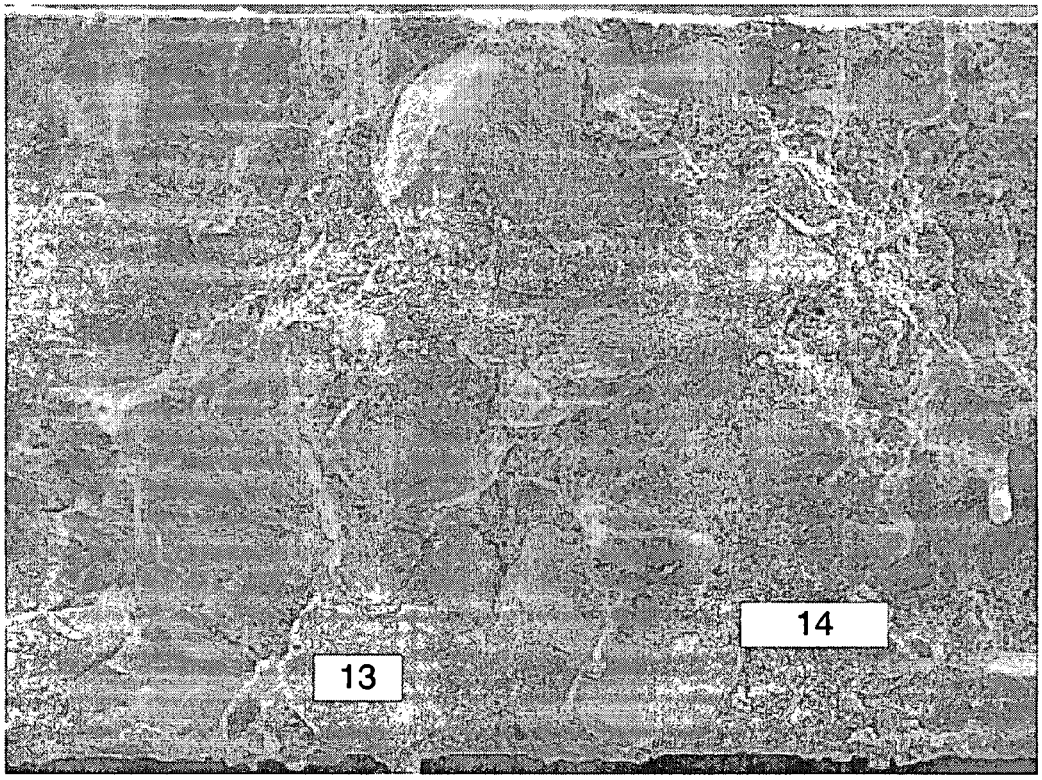
FIG. 5 is a diagram showing a fracture surface of the anisotropic bonded magnet in accordance with the exemplary embodiment.

FIG. 5 is a Scanning Electron Microscope (SEM) photograph showing a fracture surface of the anisotropic bonded magnet with a thickness of 350 μm of the present invention. In FIG. 5, relatively large powder is polycrystal assembly type $Nd_2Fe_{14}B$ powder 13 coated with binder component 12, and an aggregate of relatively small powder is $Sm_2Fe_{17}N_3$ micro-powder 14 coated with binder component 12, and they are homogeneously dispersed by melting and kneading extensible polymer molecules 21 containing lubricant 40. Damage or micro crack is not observed in polycrystal assembly type $Nd_2Fe_{14}B$ powder 13. Resin component such as boundary phase 20 or chemical contact point 30 cannot be observed in FIG. 5. The density of the bonded magnet obtained by Archimedes' method is 5.72 $Mg/m^3$. When the theoretical density including the binder component is set to be 5.77 $Mg/m^3$, the relative density of the anisotropic bonded magnet of the present embodiment is 99.01%. The theoretical density of the magnet is calculated assuming that the density of polycrystal assembly type $Nd_2Fe_{14}B$ powder 13 is 7.55 $Mg/m^3$, that of single-domain-particle type $Sm_2Fe_{17}N_3$ micro-powder 14 is 7.68 Mg/m$^3$, and that of the binder component is 1.02 Mg/m$^3$.

Thus, the anisotropic bonded magnet of the present invention has few voids, and suppresses damage such as crush or micro crack of magnet powder due to very-low-pressure compression of 15 MPa, for example, comparing with 600-1000 MPa of a conventional isotropic $Nd_2Fe_{14}B$ bonded magnet. Thanks to the low-pressure compression of 15 MPa, a compression molding tool such as upper and lower punches or a die can be advantageously made of inexpensive nonmagnetic material such as SUS 304.

Figure 6:
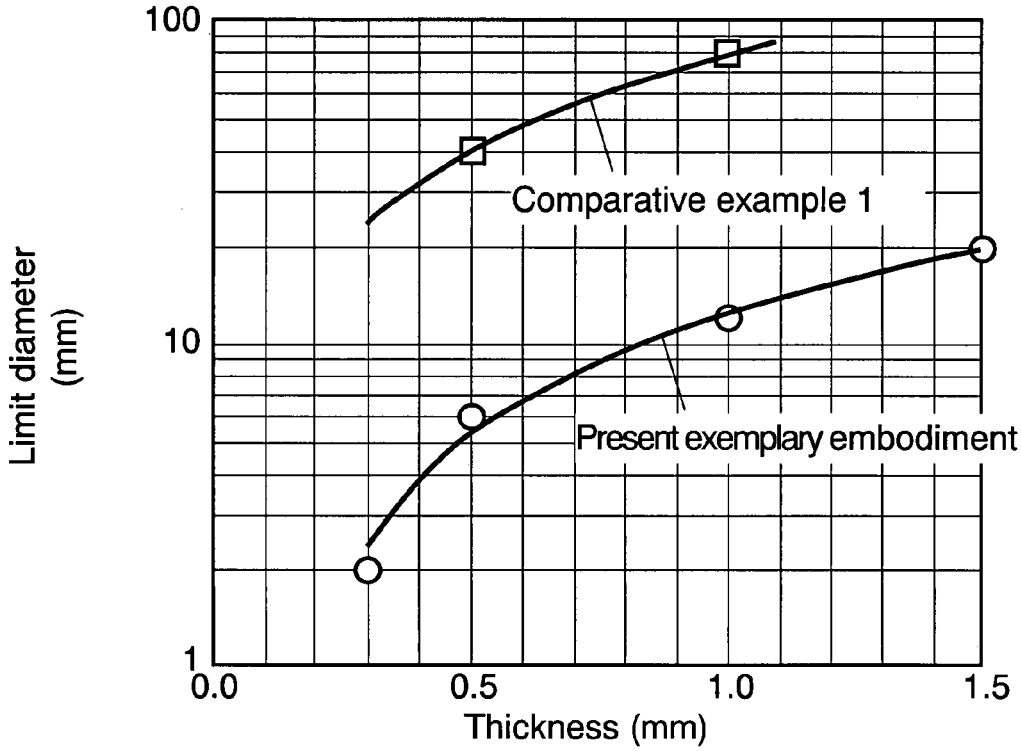
FIG. 6 is a diagram showing thickness of the anisotropic bonded magnet and a forming limit of an annular magnet in accordance with the exemplary embodiment.

FIG. 6 is a diagram showing the forming limit of annular anisotropic bonded magnets with a thickness of 300-1500 μm of the present invention. Here, each bonded magnet is rolled at draft (extensibility) 4-5% at 120° C., cooled to room temperature, and wound on a mandrel with different diameter using the flexibility in the rolling direction. A limit diameter that does not generate any micro crack is determined. Comparative example 1 of FIG. 6 corresponds to comparative examples 1 of FIG. 3 and FIG. 4, and differs from the present embodiment in that there is no network boundary phase on the boundary between composite granules. Even in example 1 where boundary phase 20 mainly made of extensible polymer molecules 21 does not exist, flexibility is generated in the rolling direction by the extension of extensible polymer molecules 21 contained in composite granules 10 by rolling.

As shown in FIG. 5, however, the dispersion of single-domain-particle type $Sm_2Fe_{17}N_3$ micro-powder 14 increases the rigidity correspondingly to the volume fraction, thereby increasing the limit diameter. In the present embodiment, network boundary phase 20 is mainly made of extensible polymer molecules 21, and the rigidity increase corresponding to the volume fraction of single-domain-particle type $Sm_2Fe_{17}N_3$ micro-powder 14 does not occur, so that the flexibility of the whole magnet is improved. For example, a magnet with a thickness of 300 μm can be wound on a mandrel with a diameter of 200 μm. In other words, by forming an annular magnet with a thickness of 300 μm on the rotating shaft with a diameter of 200 μm, an annular magnet rotor with a diameter of 0.8 mm can be formed of the anisotropic rare-earth bonded magnet. Thus, the shape flexibility is extremely higher than that of comparative example 1.

In the anisotropic bonded magnet of the present invention with a thickness of 1 mm, the MEP after 4 MA/m pulse magnetization is 147 kJ/m$^3$, and coercive force $H_{CJ}$ is 965 kA/m. Even in the anisotropic bonded magnet with a thickness of 300 μm, the MEP is 127 kJ/m$^3$, and coercive force $H_{CJ}$ is 976 kA/m.

Figure 7:
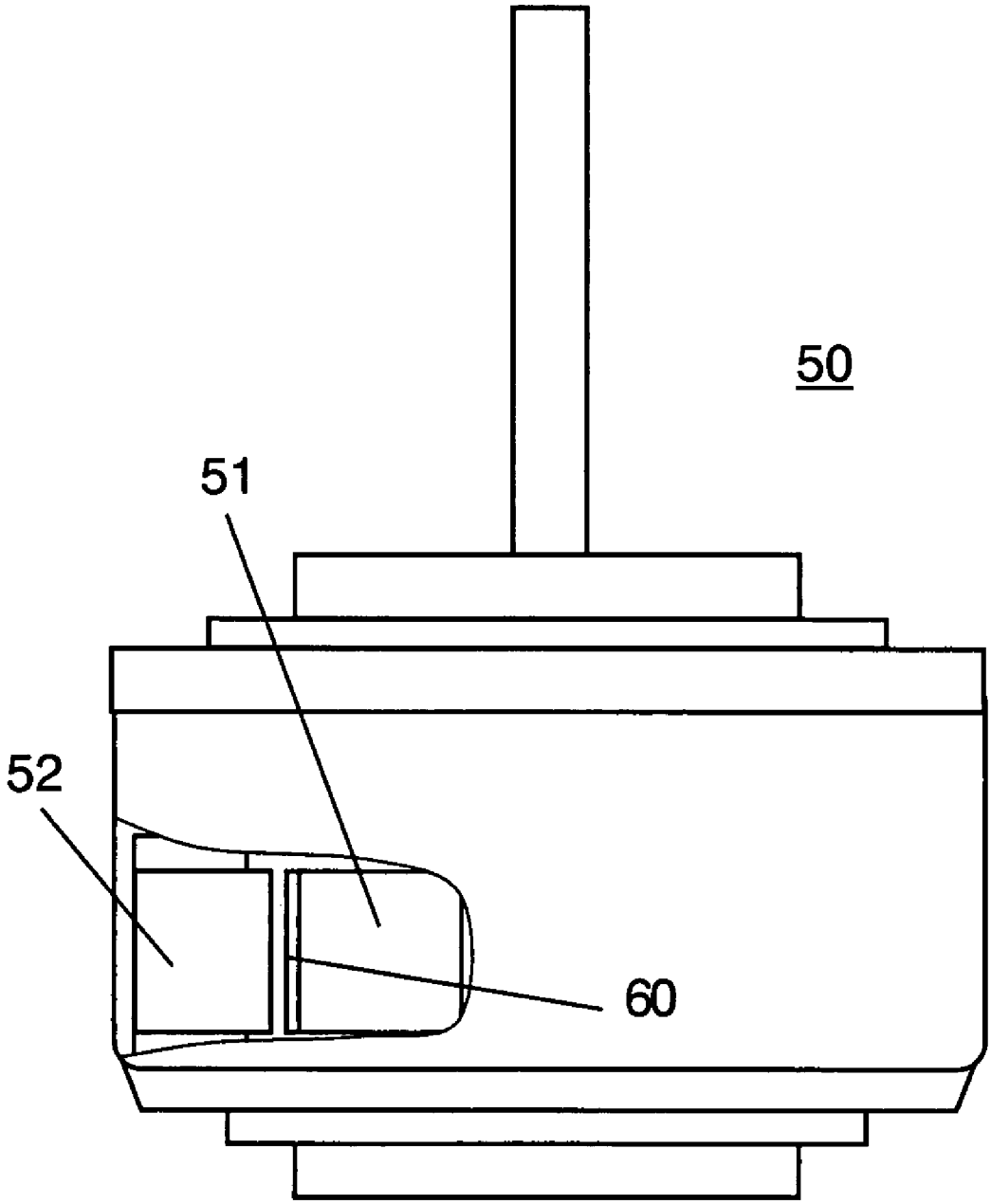
FIG. 7 is a partially cutaway view of a motor including the anisotropic bonded magnet in accordance with the exemplary embodiment.

The industrial MEP of the conventional isotropic bonded magnet is about 80 kJ/m$^3$. Japanese Patent Unexamined Publication No. H6-330102 describes that it is difficult to produce a thin magnet with a thickness shorter than 1 mm with high degree of orientation using compression molding in a parallel magnetic field. While, in the anisotropic bonded magnet of the present invention, the MEP is 127 kJ/m$^3$ even when the thickness is 300 μm. As a result, the magnetic flux density of gap between the magnet and the iron core of a permanent-magnet motor is approximately proportional to the square root of the ratio between MEPs. Therefore, using the anisotropic bonded magnet of the present invention allows output increase and downsizing by about 25% or more. FIG. 7 shows a small motor including the anisotropic bonded magnet of the present invention. Motor 50 has stator 52 and rotor iron core 51 on which anisotropic bonded magnet is wound. Rotor iron core 51 and stator 52 having ordinarily used structures can be employed.

The anisotropic bonded magnet of the present invention has a high MEP and shape flexibility, and is suitable for increase in output and decrease in size and weight of permanent-magnet motors that are demanded to have various shapes from an annular shape to a circular arc shape.

INDUSTRIAL APPLICABILITY

The present invention can provide a bonded magnet suitable for increase in output and decrease in size and weight of a magnet rotor type or magnet field type permanent-magnet motor used for driving an electrical/electronic apparatus. The present invention can also provide a small motor using this.

The invention claimed is:

1. An anisotropic rare-earth bonded magnet including a structure where a composite granule having rare-earth magnet powder, one of oligomer and prepolymer having a reaction substrate, and extensible polymer molecules is compressed and molded together with the extensible polymer molecules and a chemical contact, a boundary phase mainly made of the extensible polymer molecules is arranged in a network shape around the composite granule, the composite granule and the extensible polymer molecules are chemically bonded together at a chemical contact point, and wherein, pentaerythritol fatty triester compound (PETE) is used as a lubricant.

2. The anisotropic rare-earth bonded magnet of claim 1, wherein the composite granule is produced by melting and kneading the rare-earth magnet powder and the extensible polymer molecules, cooling them, and roughly crushing them, the rare-earth magnet powder being coated with one of the oligomer and prepolymer having the reaction substrate.

3. The anisotropic rare-earth bonded magnet of claim 2, wherein the composite granule has a structure where the rare-earth magnet powder coated with one of the oligomer and prepolymer having the reaction substrate, the extensible polymer molecules, and the lubricant are melted and kneaded, are cooled, and then are roughly crushed.

4. The anisotropic rare-earth bonded magnet of claim 3, wherein pentaerythritol C17 triester is used as the lubricant, and an addition amount of the lubricant is 3-15 parts by weight to the extensible polymer molecules of 100 parts by weight.

5. The anisotropic rare-earth bonded magnet of claim 1, wherein both the composite granule and the boundary phase have the chemical contact point.

6. The anisotropic rare-earth bonded magnet of claim 1, wherein the composite granule and the extensible polymer molecules are compressed at 5 MPa or more on the condition of melt flow accompanied by a slip, and the anisotropic rare-earth bonded magnet includes the composite granule and the network boundary phase, the composite granule having a structure where sectional surface orthogonal to the compressing direction is flat.

7. The anisotropic rare-earth bonded magnet of claim 1, wherein the rare-earth magnet powder comprises magnetically anisotropic polycrystal assembly type $Nd_2Fe_{14}B$ powder having an average particle diameter of 50 μm or larger and magnetically anisotropic single-domain-particle type $Sm_2Fe_{17}N_3$ micro-powder having an average particle diameter of 3 μm or smaller.

8. The anisotropic rare-earth bonded magnet of claim 7, wherein percentage of the magnetically anisotropic single-domain-particle type $Sm_2Fe_{17}N_3$ micro-powder in the whole rare-earth magnet powder is set at 40 wt % or more.

9. The anisotropic rare-earth bonded magnet of claim 1, wherein one of the oligomer and the prepolymer having the reaction substrate has at least one kind of epoxy compounds with a melting point of 70-100° C.

10. The anisotropic rare-earth bonded magnet of claim 1, wherein polyamide with a melting point of 80-150° C. is used as the extensible polymer molecules.

11. The anisotropic rare-earth bonded magnet of claim 1, wherein a powder-like latent epoxy resin hardener made of a hydantoin derivative is used as the chemical contact.

12. The anisotropic rare-earth bonded magnet of claim 1, wherein percentage of the rare-earth magnet powder in the anisotropic bonded magnet is set at 95 wt % or more.

13. The anisotropic rare-earth bonded magnet of claim 1, wherein the anisotropic rare-earth bonded magnet has a 1.5 mm-or-shorter thick plate shape, and the rare-earth magnet powder is anisotropic in a direction perpendicular to a surface of the plate shape.

14. The anisotropic rare-earth bonded magnet of claim 1, wherein the anisotropic rare-earth bonded magnet has a 1.5 mm-or-shorter thick plate shape, and the rare-earth magnet powder is anisotropic in an in-surface direction of the plate shape.

15. The anisotropic rare-earth bonded magnet of claim 1, wherein the anisotropic rare-earth bonded magnet has a 1.5 mm-or-shorter thick plate shape, and is compressed and molded in an oriented magnetic field that is anisotropic regularly repeatedly between a direction perpendicular to a surface of the plate shape and an in-surface direction of the plate shape.

16. The anisotropic rare-earth bonded magnet of claim 1, wherein relative density of the anisotropic rare-earth bonded magnet is 98% or higher.

17. The anisotropic rare-earth bonded magnet of claim 1, wherein the anisotropic rare-earth bonded magnet is finally formed in an annular shape by extension by rolling.

18. The anisotropic rare-earth bonded magnet of claim 1, wherein the anisotropic rare-earth bonded magnet is finally formed in a circular arc shape by extension by stamping.

19. The anisotropic rare-earth bonded magnet of claim 1, wherein maximum energy product at 20° C. after magnetization at 2.0 MA/m is 127 $kJ/m^3$ or more.

20. A permanent-magnet motor mounted with the annular anisotropic rare-earth bonded magnet of claim 17.

21. A permanent-magnet motor mounted with the circular arc anisotropic rare-earth bonded magnet of claim 18.

* * * * *